US009249794B2

(12) United States Patent
Cadet et al.

(10) Patent No.: US 9,249,794 B2
(45) Date of Patent: Feb. 2, 2016

(54) CONDITION-BASED AND PREDICTIVE MAINTENANCE OF COMPRESSOR SYSTEMS

(75) Inventors: Olivier Cadet, Bear, DE (US); Franck-Stephane Durtschi, Bear, DE (US); Omar Germouni, Chicago, IL (US)

(73) Assignee: American Air Liquide, Inc., Fremont, CA (US)

( * ) Notice: Subject to any disclaimer, the term of this patent is extended or adjusted under 35 U.S.C. 154(b) by 2736 days.

(21) Appl. No.: 11/624,948

(22) Filed: Jan. 19, 2007

(65) Prior Publication Data

US 2007/0177982 A1 Aug. 2, 2007

Related U.S. Application Data

(60) Provisional application No. 60/761,511, filed on Jan. 24, 2006.

(51) Int. Cl.
*F04B 49/08* (2006.01)

(52) U.S. Cl.
CPC ..... *F04B 49/08* (2013.01)

(58) Field of Classification Search
CPC ..... F04B 49/08
USPC ..... 702/182–185, 188; 62/125, 129, 166, 62/190
See application file for complete search history.

(56) References Cited

U.S. PATENT DOCUMENTS

| | | | | |
|---|---|---|---|---|
| 4,581,900 | A * | 4/1986 | Lowe | F04D 27/001 415/17 |
| 4,686,834 | A * | 8/1987 | Haley | F04D 27/02 62/209 |
| 5,967,757 | A * | 10/1999 | Gunn | F04B 49/065 417/34 |
| 6,529,849 | B2 * | 3/2003 | Umezawa et al. | 702/136 |
| 7,047,158 | B2 | 5/2006 | Roba et al. | |
| 7,082,380 | B2 * | 7/2006 | Wiebe et al. | 702/182 |
| 7,275,018 | B2 * | 9/2007 | Abu-El-Zeet et al. | 702/182 |
| 7,291,934 | B2 * | 11/2007 | Bernardi et al. | 290/40 A |
| 2004/0025523 | A1 * | 2/2004 | Bodell, II | F04D 27/0253 62/228.1 |
| 2004/0048118 | A1 * | 3/2004 | Nakaji et al. | 429/22 |
| 2004/0243636 | A1 * | 12/2004 | Hasiewicz et al. | 707/104.1 |
| 2006/0155514 | A1 * | 7/2006 | Drouart et al. | 702/182 |

FOREIGN PATENT DOCUMENTS

| | | |
|---|---|---|
| FR | 2857598 | 1/2005 |

* cited by examiner

*Primary Examiner* — Hyun Park
(74) *Attorney, Agent, or Firm* — Elwood L. Haynes

(57) ABSTRACT

Embodiments of the invention provide a condition-based maintenance tool that may be used to monitor, configure, and in some cases correct, problems experienced by a compressor in a pipeline system. The condition-based maintenance tool may evaluate data retrieved from a compressor status database to identify overconsumption events. In response, the maintenance tool may generate maintenance alarms, initiate work orders, and/or provide recommendations for action to an operator.

22 Claims, 5 Drawing Sheets

CONDITION-BASED AND PREDICTIVE MAINTENANCE OF COMPRESSOR SYSTEMS

CROSS-REFERENCE TO RELATED APPLICATIONS

This application claims the benefit under 35 U.S.C. §119 (e) to provisional application No. 60/761,511, filed Jan. 24, 2006, the entire contents of which are incorporated herein by reference.

BACKGROUND

Generally, a pipeline system provides a continuous pipe conduit that may include a variety of components and equipment, e.g., valves, compressor stations, communications systems, and meters. A pipeline may be used to transport liquid or gaseous materials from one point to another, usually from one point (or points) of production or processing to another, or to points of use. At compressor stations, one or more compressors maintain the pressure of gaseous material in a pipeline, as it is transported from one site to another. Similarly, for a liquid bearing pipeline, pumps may be used to maintain the pressure of liquid transported by a pipeline.

Obviously, running and maintaining a pipeline system can be expensive, and an important goal for the pipeline operator is to reduce operational costs. One substantial expense for the pipeline operator is the electricity required to run the compressors (or pumps) of the pipeline. At a minimum, an improperly maintained (or configured) compressor can require more electricity, and thus more money to run, than a properly configured one. This state is often referred to as "overconsumption," i.e., a state where the compressor is operating and maintaining a desired pressure level in the pipeline, but consuming more electricity than is required (or was estimated) to accomplish this task. Further, at some point the performance of a malfunctioning (or improperly configured) compressor may degrade to the point where the pressure of the material transported in the pipeline falls to unacceptable levels, or the compressor may simply cease to operate at all.

The operations of a pipeline system may be coordinated and controlled from a central operations control center. At such a control center, an operator may monitor the operational state of the compressors used by a pressurized gas pipeline. To perform this task, software applications are available that monitor the operational state of pipeline components, including compressors and pumps. Sensors affixed to the pipeline components are used to relay information regarding a then current state of the pipeline to the control center. In some cases, the monitoring systems may be configured to raise an alarm when a monitored parameter (or combination of parameters) falls below (or climbs above) a predetermined value. However, these applications typically only provide an operator with alarm information for a specific overconsumption case. That is, the alarm may inform the operator that some monitored parameter is exceeding (or falling below) a specified threshold. This approach leaves the action to be taken, if any, to the discretion of the operator. Thus, this approach relies heavily on operator availability, skills, and knowledge to address and correct a problem with a compressor. Unfortunately, therefore, this approach does not ensure that a problem gets solved or even logged. In addition, even when an overconsumption problem is corrected, consistency in the solution is not guaranteed. A recurrent problem may frequently need an identical corrective action. However, because of the reliance on the control center operator, this does not always occur.

Accordingly, there remains a need for techniques for optimizing the operations of a pipeline system. Typically, the optimization process should be used to identify an allowable state of pipeline operations that satisfies any operational requirements, physical abilities, and that minimizes operational costs, most notably power consumption.

SUMMARY

One embodiment of the invention provides a computer-implemented method of performing condition-based predictive compressor maintenance. The method generally includes determining an estimated power consumption level of a compressor for a given time period, monitoring one or more operational parameters of the compressor during the time period and an actual power consumption level of the compressor during the time period and determining whether a power over consumption event has occurred, based on the estimated power consumption level and the actual consumption level. The method further includes, upon determining a power over consumption event has occurred, evaluating the monitored operational parameters to determine an appropriate corrective action performing the corrective action for the overconsuming compressor.

Another embodiment of the invention includes a computer-readable storage medium containing a program configured to perform condition-based predictive compressor maintenance. The program generally includes instructions for performing an operation of determining an estimated power consumption level of a compressor for a given time period, monitoring one or more operational parameters of the compressor during the time period and an actual power consumption level of the compressor during the time period, and determining whether a power over consumption event has occurred, based on the estimated power consumption level and the actual consumption level. The operation generally further includes, upon determining a power over consumption event has occurred, evaluating the monitored operational parameters to determine an appropriate corrective action and performing the corrective action for the overconsuming compressor.

Another embodiment of the invention includes a system for performing condition-based predictive compressor maintenance. The system generally includes a supervisory control and data acquisition system used to monitor a set of operational parameters one or more compressors in a pipeline and an actual power consumption level of the compressor during a time period, a compressor status database configured to record values for the operational parameters and the actual power consumption level during occurring the time period, and a diagnostic and maintenance tool. The diagnostic and maintenance tool may be generally configured to determine an estimated power consumption level of a compressor for the time period, determine whether a power overconsumption event has occurred, based on the estimated power consumption level and the actual consumption level. Upon determining a power overconsumption event has occurred, the diagnostic and maintenance tool may be configured to evaluate the monitored operational parameters to determine an appropriate corrective action and to perform the corrective action for the overconsuming compressor.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
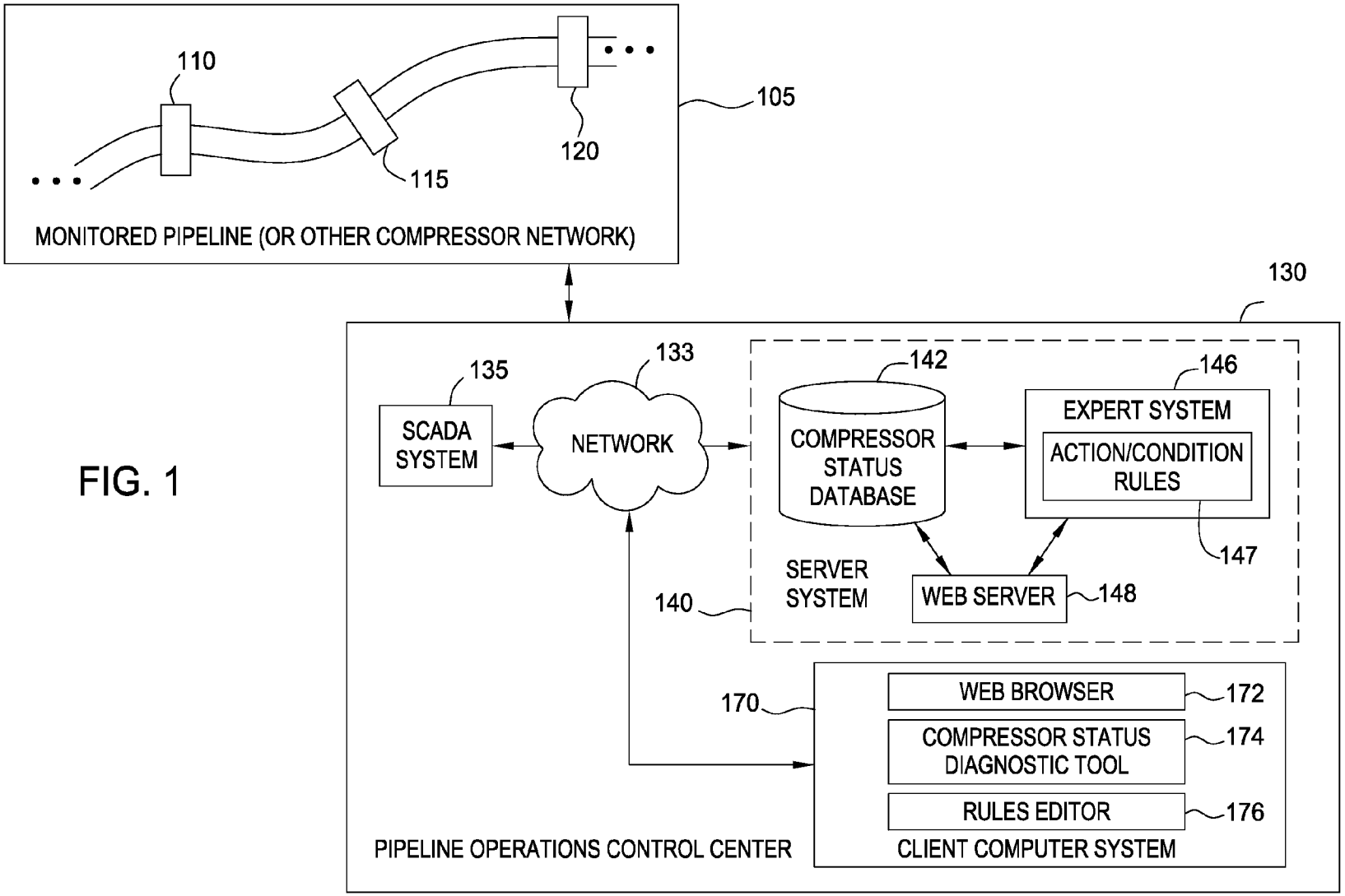
FIG. 1 is a conceptual illustration of a monitored pipeline and an operations control center, according to one embodiment of the invention.

Embodiments of the invention provide a condition-based maintenance tool that may be used to monitor, configure, and in some cases correct, problems experienced by a compressor in a pipeline system. For purposes of illustration, embodiments of the invention are described with respect to overconsumption events. However, more generally, the embodiments of the invention disclosed herein are equally applicable to any event of interest. Similarly, embodiments of the invention are described using a pipeline system as an example of a system that includes one or more compressor devices. Of course, one of ordinary skill in the art will recognize that embodiments of the invention may be adapted for use with compressors employed by a gas production facility as well as other facilities that employ compressors as part of their operations.

In one embodiment, the condition-based maintenance tool may evaluate data retrieved from a compressor status database to identify overconsumption events. In response, the maintenance tool may generate maintenance alarms, initiate work orders, and/or provide recommendations for action to an operator. Thus, some embodiments of the invention determine that an overconsumption event has occurred (or is occurring), and then trigger an appropriate corrective action. Examples of corrective actions include automatic modification of operating conditions, release of maintenance work orders or detailed instructions to an operator for further action, etc. Overconsumption events may be logged, allowing the operator to review any automated corrective action taken by the maintenance tool. Additionally, the operator may evaluate the effectiveness of any corrective action and, in turn, improve the maintenance tool by modifying the rules used to determine what corrective action to perform in a particular case. Thus, both the consistency and effectiveness of the condition-based maintenance tool may be improved, over time.

In a particular embodiment, an expert system may be used to determine what corrective action to take in response to an overconsumption event. As is known, expert systems are programs that include a set of rules used to analyze information (usually supplied by the user of the system) about a specific class of problems, as well as provide analysis of the problem(s), and, in some cases, recommend a course of user action in order to implement corrections. Typically, the problems to be solved are of the sort that would normally be address by a human "expert." And expert systems are used for problems for which there is no single "correct" solution which can be encoded in a conventional algorithm.

Embodiments of the invention are described relative to a condition-based and predictive maintenance tool used to maintain compressor systems in a pressurized gas pipeline network. However, one of ordinary skill in the art will recognize that the maintenance tool disclosed herein may be adapted for compressor systems used for a variety of purposes, as well as for other pipeline components (e.g., pumps used to maintain a liquid pressure within a pipeline) and for other applications. More generally, the operation of other process equipment monitored using real-time diagnostic tools could benefit from the condition-based and predictive maintenance tool disclosed herein.

One embodiment of the invention may be implemented as one or more software programs for use with a computer system. The program(s) include instructions for performing embodiments of the invention (including the methods described herein) and may be stored on a variety of computer-readable media. Illustrative computer-readable media include, but are not limited to: (i) non-writable storage media on which information is permanently stored (e.g., read-only memory devices within a computer such as CD-ROM or DVD-ROM disks readable by a CD-ROM or DVD-ROM drive) and/or (ii) writable storage media on which alterable information is stored (e.g., floppy disks within a diskette drive, hard-disk drives, or flash memory devices). Other media include communications media through which information is conveyed to a computer, such as a computer or telephone network, including wireless communications networks. The latter embodiment specifically includes transmitting information to/from the Internet and other networks. Such computer-readable media, when carrying computer-readable instructions that direct the functions of the present invention, represent embodiments of the present invention.

Further, the description herein references embodiments of the invention. However, it should be understood that the invention is not limited to any specifically described embodiments. Instead, any combination of the following features and elements, whether related to different embodiments or not, is contemplated to implement and practice the invention. Furthermore, in various embodiments the invention provides numerous advantages over the prior art. However, although embodiments of the invention may achieve advantages over other possible solutions and/or over the prior art, whether or not a particular advantage is achieved by a given embodiment is not limiting of the invention. Thus, the following aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

In general, the routines executed to implement the embodiments of the invention, may be part of an operating system or a specific application, component, program, module, object, or sequence of instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

FIG. 1 is a conceptual illustration of a monitored pipeline 105 and an operations control center 130, according to one embodiment of the invention. As shown, monitored pipeline network 105 includes three compressor stations 110, 115, and 120. Each of compressor stations 110, 115, and 120 may include one or more compressors used to maintain the gas pressure present in pipeline 105.

Additionally, compressor stations 110, 115, and 120 may include sensor equipment used to monitor aspects of the operational state of pipeline 105. For a pressurized gas pipeline, a wide variety of compressor parameters may be monitored including, for example, inlet gas pressure, outlet gas pressure, gas temperature, cooling liquid temperature, flow rates, and power consumption, among others. Of course, for other applications of the invention, the sensors or monitoring equipment may be selected to suit the needs of a particular case. The monitoring may be dynamic (i.e., "real-time"), or periodic where an operational parameter of the pipeline is sampled (or polled) at periodic intervals.

In one embodiment, the results of the monitoring equipment are transmitted to pipeline operations control center 130. The pipeline operation control center 130 may employ a number of computer systems running application programs used to coordinate, monitor, and control the operations of pipeline 105. Illustratively, the pipeline operations control center 130 includes a SCADA system 135, a server system 140, and a client system 170, communicating with one another over a network 133. The computer systems 135, 140, and 170 illustrated in operations control center 130 are included to be representative of existing computer systems, e.g., desktop computers, server computers, laptop computers, tablet computers and the like. However, embodiments of the invention are not limited to any particular computing system, application, device, architecture or network, and instead, may be adapted to take advantage of new computing systems and platforms as they become available. Additionally, one skilled in the art will recognize that the illustrations of computer systems 135, 140, and 170 are simplified to highlight aspects of the present invention and that computing systems and networks typically include a variety of components not shown in FIG. 1.

SCADA system 135, short for Supervisory Control And Data Acquisition system, centralizes process data and allows remote monitoring and control of pipeline 105. As is known, a SCADA system 135 may be configured to gather data in real time from remote locations in order to control equipment and conditions in pipeline 105. SCADA system 135 may include both hardware and software components. The hardware gathers and feeds data into SCADA system 135, which processes this data and presents it to a user.

Illustratively, server system 130 includes a compressor status database 142, an expert system 146, and a web server 148. Compressor status database 142 may be configured to retrieve data from SCADA system 135 relevant to the operation of compressors 110, 115, and 120. That is, the SCADA system 135 may monitor the operations of many components of pipeline 105, not all of which may be related to compressors at compressor stations 110, 115, and 120. Accordingly, in one embodiment, sever system 142 may be configured to store data relevant to the compressors at compressor stations 110, 115, and 120 in compressor status database 142. Compressor status database 142 may also be used to archive input and output results for a compressor status diagnostic tool 174 and expert system 146. For example, database 142 may log any corrective action initiated by diagnostic tool 174.

In one embodiment, expert system 146 may be configured to use a set of action/condition rules 147 to determine an appropriate corrective action to initiate when an overconsumption event is identified. The action/condition rules 147 may be developed by human-experts in a given problem domain (e.g., experts in the operation of gas pressurized pipeline compressor systems operation and maintenance).

Web server 148 may be configured to provide a specific service to client software (e.g., a web browser) running on other computers. More specifically, web server 148 is a software application that manages and shares web based applications accessible from other computers connected by a network. In the context of the present invention, the web server 148 may be used to transmit compressor status data from database 142 and expert system 146 to client computer system 170 and diagnostic tool 174. Typically, web server 148 is configured to transmit HTML web pages rendered by a web browser, where the content of the web pages presents the information from database 142 and expert system 146 in a structured form.

Accordingly, client computer system 170 includes a web browser 172, used to render information received from web server 148. Additionally, client computer system 170 includes a compressor status diagnostic tool 174 and a rules editor 176. In one embodiment, diagnostic tool 174 may be configured to interact with compressor status database 142 to monitor the state of pipeline compressors and to identify when a power overconsumption has occurred (or is occurring). In one embodiment, diagnostic tool 174 detects compressor overconsumption by comparing measured power consumption to estimated power consumption. And in the case of overconsumption, may be configured to trigger an overconsumption alarm. In response, expert system 146 may analyze the compressor status to determine the appropriate corrective action.

In a particular embodiment, diagnostic tool 174 may be configured to estimate power consumption for a given compressor using a non-linear model calibrated with historical data obtained by SCADA system 135 and stored in compressor status database 142. Detailed examples of techniques for estimating the power consumption of a compressor are described in WO 03/079128 (filed 26 Sep. 2003) and FR-A1-2 857 598 (filed 20 Mar. 2002, pub. 26 Sep. 2003). Of course, for other applications of the invention, the technique used to estimate power consumption (or other parameters) of monitored equipment (e.g., compressors in a pressurized gas pipeline) may be selected to suit the needs of a particular case. Rules editor 176 may allow an operator to create and/or edit actions/condition rules 147 to use in determining the corrective action to be taken in response to an overconsumption event. Typically, an Operator may define appropriate actions based on specific conditions in an "if [condition x] then take [corrective action y]" manner. This also allows new cases identified by an operator that are not covered by existing rules 147 to be addressed by adding new rules to action/condition rules 147.

Note, although database 142, expert system 146 and web server 148, are shown as part of a single server system 140, one of ordinary skill in the art will recognize that these components may be organized on multiple computer systems and configured in a variety of ways.

Figure 2:
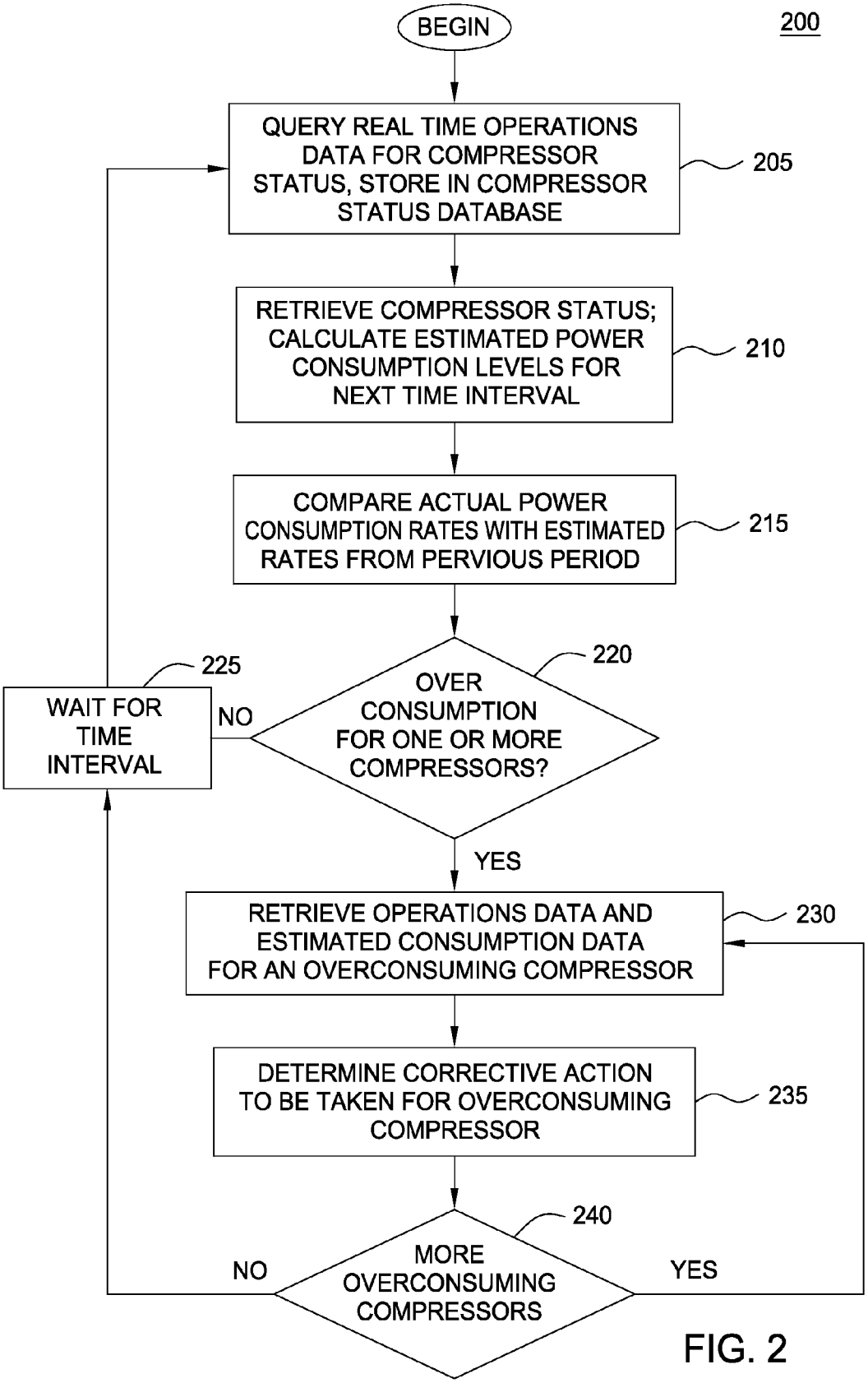
FIG. 2 illustrates a method for condition-based predictive maintenance of a compressor system, according to one embodiment of the invention.

FIG. 2 illustrates a method 200 for condition-based predictive maintenance of a compressor system, according to one embodiment of the invention. In one embodiment, the method 200 may be performed using the computer systems described above relative to the pipeline operations control center 130 of FIG. 1. However, one of ordinary skill in the art will recognize that when used herein, examples of specific equipment, software, and products are provided for illustrative purposes, and other types of these items may be used without departing from the scope of the present invention.

As shown, the method 200 begins at step 205 where real time process data related to compressor status is stored in database 142. In one embodiment, the SCADA system may be configured to "push" data from compressor stations into the database 142. Alternatively, database 142 may be configured to "pull" data related to compressor status into database 142. At step 210, the compressor status data may be used to calculate an estimated power consumption level for a future time period. For example, diagnostic tool 174 may be configured to query compressor status database for the most recent historical data available for a compressor and use this data to estimate a power consumption level for a future time period.

As pipeline operations are an ongoing process, an estimated power consumption rate from a previous time period may be available. If so, at step 215, diagnostic tool 174 may be configured to compare the actual power consumption rates for a given time period with the estimated power consumption rates for that time period. That is, diagnostic tool 174 may determine whether an overconsumption event has occurred (or is occurring) for a given compressor based on a comparison of actual versus estimated power consumption rates. At step 220, if diagnostic tool 174 does not identify that any overconsumption events have occurred, then, at step 225, diagnostic tool 174 may wait for an appropriate time interval. For example, a time period of one hour may be used to monitor compressors used by a pressurized gas pipeline.

Otherwise, if one or more compressors are identified as being in an "overconsuming" state, then at step 230, the current operational parameters of an overconsuming may be retrieved from SCADA system 135 (or from database 142). As stated above, monitored compressor parameters may include inlet gas pressure, outlet gas pressure, gas temperature, cooling liquid temperature, flow rates, and power consumption, among others. At step 235, based on the actual parameters, and on actions/condition rules 147, a corrective action to be taken for the overconsuming compressor may be determined and logged. If additional compressors have been identified as being in an overconsuming state, then steps 230 and 235 may be repeated to determine a corrective action for additional compressors. Otherwise, at step 225, diagnostic tool 174 may wait for an appropriate time interval before returning to step 205, where the method 200 may be repeated for a subsequent time period.

Figure 3:
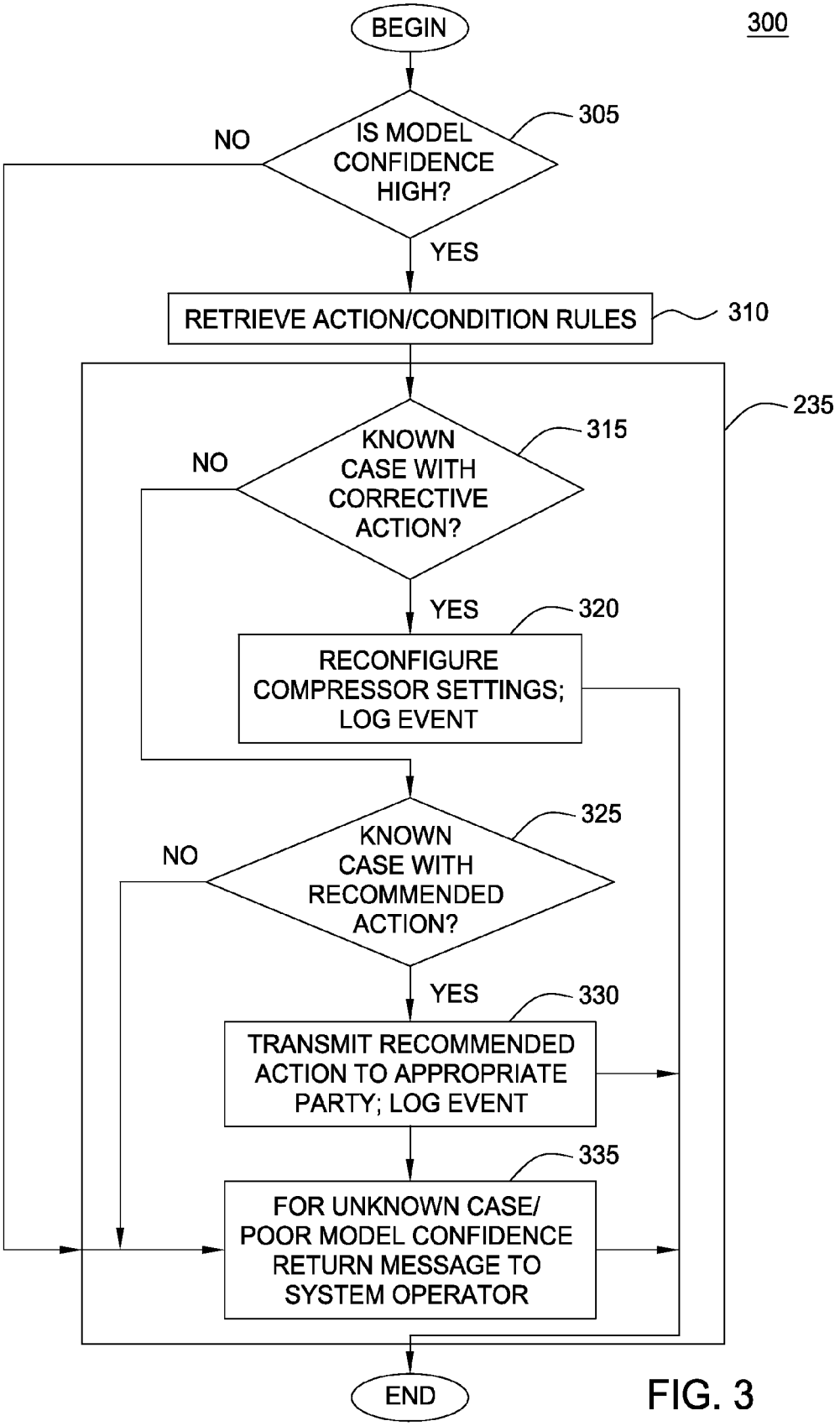
FIG. 3 illustrates a method for determining a corrective action to be performed in response to a compressor maintenance and monitoring tool detecting an overconsumption condition at a compressor, according to one embodiment of the invention.

FIG. 3 illustrates a method for determining a corrective action to be performed in response to a compressor maintenance and monitoring tool determining that an overconsumption condition has occurred (or is occurring) at a compressor, according to one embodiment of the invention. In one embodiment, the method 300 is representative of actions performed at step 235 of the method 200 shown in FIG. 2.

As shown, the method 300 begins at step 305 a confidence value for an estimated power consumption value is determined. A model confidence value may be determined using a variety of statistical techniques. For example, statistical scoring techniques may be used. If expert system 146 determines that the quality of the estimate of power consumption is poor, or that the probability is low that a compressor identified as being in an overconsumption state is, in fact, overconsuming, then the system may decline to determine a corrective action; and instead, at step 335, return a message to the operator and log the details of the possibly erroneous overconsumption event. Otherwise, if there is a high probability that an overconsumption event has, in fact, occurred (or is occurring), then at step 310, expert system 146 may retrieve the action/condition rules 147 that are applicable for a given compressor. Depending on the rules, and the particular set of operating state values for a given compressor, expert system 147 may determine a an appropriate corrective action to be taken to correct the overconsumption condition.

At step 315, if the overconsumption is occurring due to known cause with a known corrective action, then at step 320, the diagnostic tool 174 may be configured to actively modify the operations of the overconsuming compressor in an attempt to correct the overconsumption state. For example, in one embodiment, diagnostic tool 174 may receive a response from the expert system 146 to modify a compressor setting. And in response, the diagnostic tool 174 may transmit new operational settings the overconsuming compressor. Such adjustments may modify compressor settings, such as inlet gas pressure, outlet gas pressure, gas temperature, cooling liquid temperature, or the flow rates of a given compressor. Otherwise, if the expert system 146 determines that the compressor is overconsuming due to a known cause with a recommended action, (step 325), then diagnostic tool 174 may transmit the recommended action to the appropriate party (step 330). For example, expert system 146 may determine, based on the operational state of a compressor, that some specific maintenance action is required. If so, the diagnostic tool 174 may transmit a message to the appropriate party requesting the maintenance action be performed.

In some cases, however, the expert system may be unable to determine a definitive cause, or response, to an overconsumption event. In such a case, the diagnostic tool may return a message to the system operator indicating that an unknown, or indeterminate overconsumption event has occurred (or is occurring) allowing the system operator to investigate further to determine the appropriate corrective action (step 335). Additionally, unknown cases may alert the operator to craft additional condition/action rules 147 to cover the unknown case once a cause/solution are determined. Thereafter, should a similar overconsumption event occur, then the expert system may be able to determine a specific corrective action that should be performed.

EXAMPLES

Figure 4A:
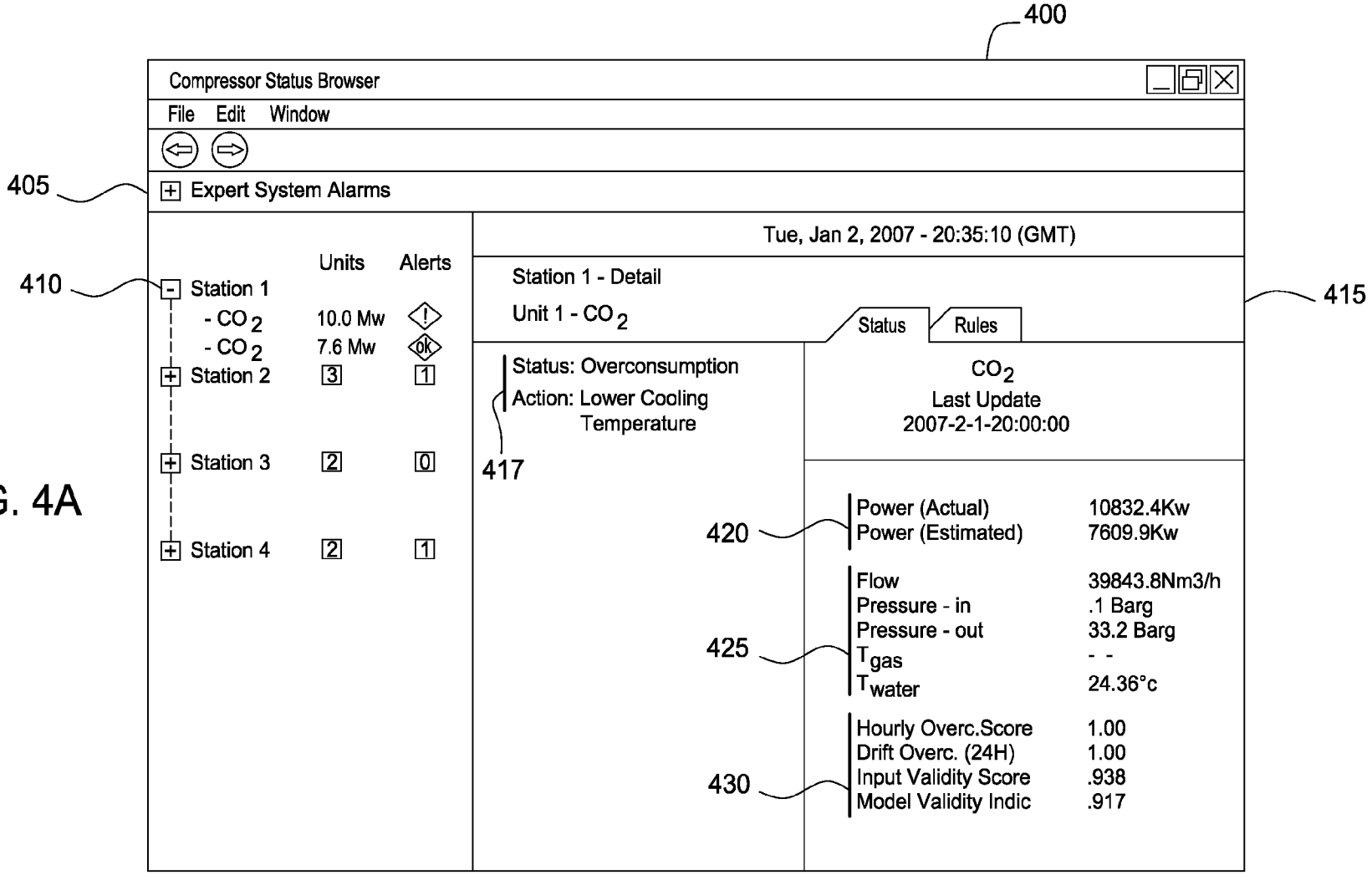
FIGS. 4A-4B illustrate an example graphical user interface provided by a compressor maintenance and monitoring tool, according to one embodiment of the invention.
Figure 4B:
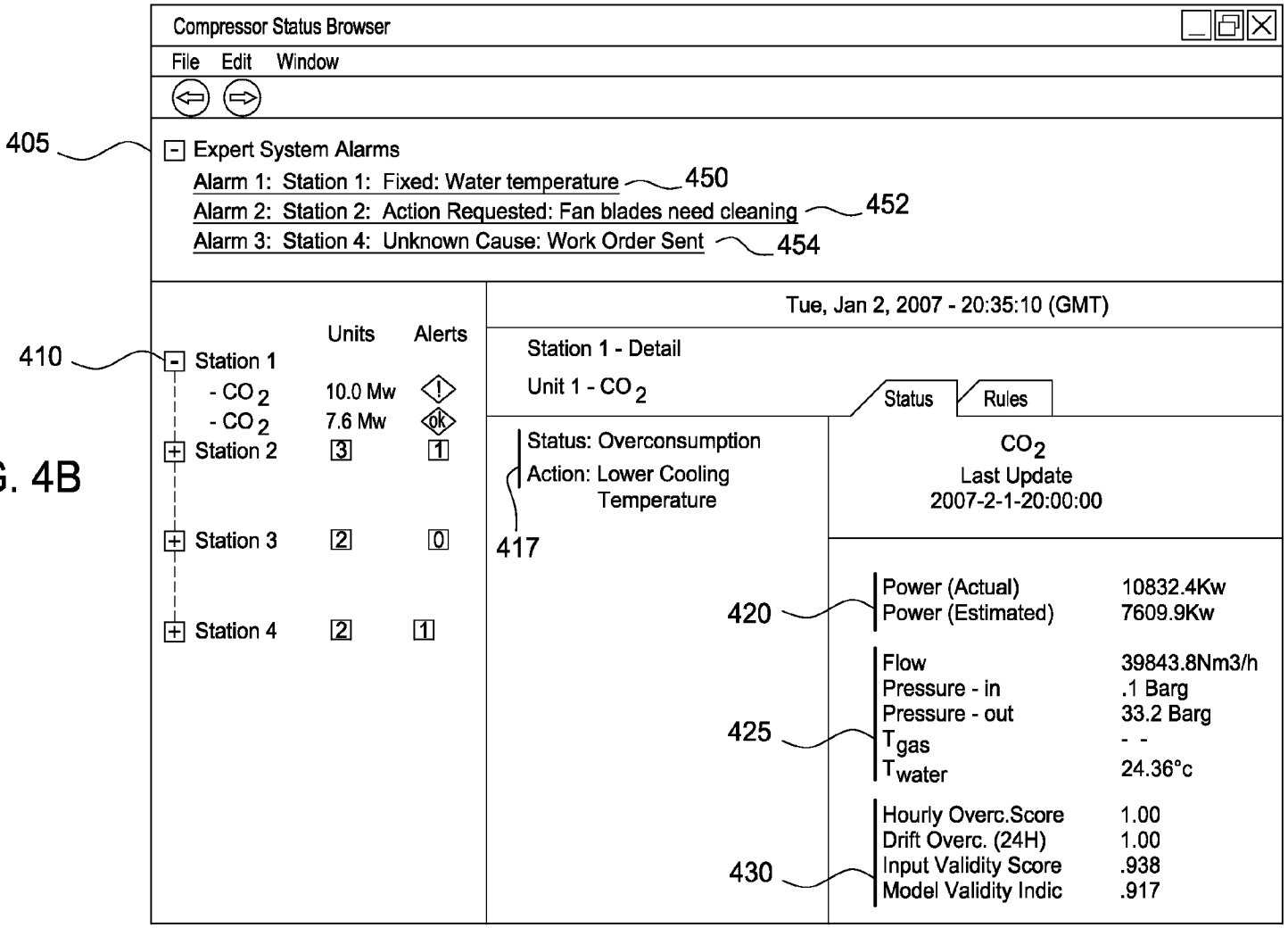

FIGS. 4A-4B illustrate an example graphical user interface provided by a compressor maintenance and monitoring tool, according to one embodiment of the invention. First, FIG. 4A shows presents a screen display 400 that includes an expert system alarm section 405, a tree-list 410 of compressor stations and a compressor station detail section 415.

The tree-list 410 shows data for a network of four compressor stations: "Station 1," "Station 2," "Station 3," and "Station 4." Illustratively, the details of tree-list 410 are expanded to show that "Station 1" includes two $CO_2$ compressors, one of which is in an overconsumption state (as indicated by the "!" icon in the "alerts" column). "Station 2" includes three compressors, one of which has a current overconsumption alert. "Station 3" includes two compressors, with no overconsumption alerts, and "Station 4" includes two compressors, one of which has a current overconsumption alert. Detail section 415 shows current operational values for the "Unit 1" $CO_2$ compressor. Specifically, power data 420 shows the actual and estimated power consumption for this compressor. In this case, values of 10.832 megawatts of power actual consumption versus 7.609 megawatts, indicating an overconsumption event for this compressor.

A current status section 417 indicates that an overconsumption event has occurred for this compressor. Operational state parameters 425 show the latest operational state data for this compressor from SCADA system 135. Specifically, the flow rates, input pressure, output pressure, and water temperature for this compressor are displayed. Diagnostic data 430 shows the estimations made by diagnostic tool as to whether this compressor has experienced (or is experiencing an overconsumption event). As shown, an hourly score of "1.0" indicates an estimated 100% probability that this compressor has experienced an overconsumption event during the previous time interval. The drift overconsumption score allows may be used to show a trend for this compressor over time. That is, if a compressor is trending towards an overconsumption threshold, over time, then the drift overconsumption score should trend towards higher values. Input validity and model validity scores are used to estimate the quality of input data used by the diagnostic tool 174 to identify the overconsumption event. In this case scores above 90% would typically indicate a high degree of confidence in the accuracy of the overconsumption score of 1.0 for this compressor.

FIG. 4B shows the screen display 400 after the expert system alarm section 405 has been expanded to show all current overconsumption alerts. Illustratively, the alarms section 405 provides a summary list of the current overconsumption alarms for stations 1, 2, and 4 shown in tree-list 410, along with the corrective action recommended (or taken) by the diagnostic tool 174 for each alarm. Specifically, the alarm 450 for station 1, is indicated to have been resolved via a modification to the operational state of the overconsuming compressor; alarm 452 is indicated to have been resolved via requested maintenance sent to the appropriate party; and alarm 454 is shown to have not been resolved by the expert system 147, causing diagnostic tool 174 to send a generic work order, requesting further investigation.

Advantageously, embodiments of the invention use an expert system to determine and trigger a corrective action for condition-based and predictive maintenance of compressor systems. The maintenance action may include automatic modification of operating conditions, generating of maintenance work orders or simply detailed instructions to the appropriate party requesting remedial action. All cases encountered during operations may be logged and brought to the attention of the pipeline operator. In this way, the pipeline operator is allowed, in turn, to improve the expert system database. This will ensure that a problem is addressed correctly when a particular set of conditions creating an overconsumption condition subsequently occurs.

Preferred processes and apparatus for practicing the present invention have been described. It will be understood and readily apparent to the skilled artisan that many changes and modifications may be made to the above-described embodiments without departing from the spirit and the scope of the present invention. The foregoing is illustrative only and that other embodiments of the integrated processes and apparatus may be employed without departing from the true scope of the invention defined in the following claims.

What is claimed is:

1. A computer-implemented method of performing condition-based predictive compressor maintenance, comprising:

determining, by operation of one or more computer processors, an estimated power consumption level of a compressor for a given time period;

monitoring one or more operational parameters of the compressor during the time period and an actual power consumption level of the compressor during the time period;

determining, by operation of the one or more computer processors, whether a power over consumption event has occurred, based on the estimated power consumption level and the actual consumption level;

upon determining a power over consumption event has occurred, evaluating the monitored operational parameters to determine an appropriate corrective action, wherein the corrective action comprises modifying an operational state of the compressor reflected in one of the operational parameters; and performing the corrective action for the compressor experiencing the power overconsumption event.

2. The method of claim 1, wherein the corrective action comprises transmitting instructions for specific compressor maintenance to a compressor operator.

3. The method of claim 1, wherein the corrective action comprises transmitting a generic work-order to a compressor operator to service the compressor.

4. The method of claim 1, wherein the one or more operational parameters include inlet gas pressure, outlet gas pressure, gas temperature, cooling liquid temperature, flow rates, and power consumption.

5. The method of claim 1, wherein the corrective action is determined by an expert system configured to evaluate one or more action/condition rules.

6. The method of claim 1, further comprising, logging the corrective action performed for the compressor experiencing the power overconsumption event.

7. The method of claim 1, wherein the compressor is used to pressurize gas within a pipeline.

8. A non-transitory computer-readable storage medium containing a program configured to perform condition-based predictive compressor maintenance, the program including instructions for performing an operation, comprising:

determining an estimated power consumption level of a compressor for a given time period;

monitoring one or more operational parameters of the compressor during the time period and an actual power consumption level of the compressor during the time period;

determining whether a power over consumption event has occurred, based on the estimated power consumption level and the actual consumption level;

upon determining a power over consumption event has occurred, evaluating the monitored operational parameters to determine an appropriate corrective action wherein the corrective action comprises modifying an operational state of the compressor reflected in one of the operational parameters; and performing the corrective action for the compressor experiencing the power overconsumption event.

9. The non-transitory computer-readable storage medium of claim 8, wherein the corrective action comprises transmitting instructions for specific compressor maintenance to a compressor operator.

10. The non-transitory computer-readable storage medium of claim 8, wherein the corrective action comprises transmitting a generic work-order to a compressor operator to service the compressor.

11. The non-transitory computer-readable storage medium of claim 8, wherein the one or more operational parameters include inlet gas pressure, outlet gas pressure, gas temperature, cooling liquid temperature, flow rates, and power consumption.

12. The non-transitory computer-readable storage medium of claim 8, wherein the corrective action is determined by an expert system configured to evaluate one or more action/condition rules.

13. The non-transitory computer-readable storage medium of claim 8, wherein the operations further comprise, logging the corrective action performed for the compressor experiencing the power overconsumption event.

14. The non-transitory computer-readable storage medium of claim 8, wherein the compressor is used to pressurize gas within a pipeline.

15. A system for performing condition-based predictive compressor maintenance, comprising:

a supervisory control and data acquisition system used to monitor a set of operational parameters one or more compressors in a pipeline and an actual power consumption level of the compressor during a time period;

a compressor status database configured to record values for the operational parameters and the actual power consumption level during occurring the time period; and a diagnostic and maintenance tool configured to:

determine an estimated power consumption level of a compressor for the time period, determine whether a power overconsumption event has occurred, based on the estimated power consumption level and the actual consumption level, upon determining a power overconsumption event has occurred, evaluate the monitored operational parameters to determine an appropriate corrective action, wherein the corrective action comprises modifying an operational state of the compressor reflected in one of the operational parameters, and perform the corrective action for the compressor experiencing the power overconsumption event.

16. The system of claim 15, wherein the corrective action comprises transmitting instructions for specific compressor maintenance to a compressor operator.

17. The system of claim 15, wherein the corrective action comprises transmitting a generic work-order to a compressor operator to service the compressor.

18. The system of claim 15, wherein the one or more operational parameters include inlet gas pressure, outlet gas pressure, gas temperature, cooling liquid temperature, flow rates, and power consumption.

19. The system of claim 15, further comprising an expert system configured to evaluate one or more action/condition rules to determine the corrective action to be performed.

20. The system of claim 15, wherein the diagnostic and maintenance tool is further configured to log the corrective action performed for the compressor experiencing the power overconsumption event in the compressor status database.

21. A computer-implemented method of performing condition-based predictive compressor maintenance, comprising:

determining, by operation of one or more computer processors, an estimated power consumption level of a compressor for a given time period;

monitoring one or more operational parameters of the compressor during the time period and an actual power consumption level of the compressor during the time period;

determining, by operation of one or more computer processors, whether a power over consumption event has occurred, based on the estimated power consumption level and the actual consumption level;

upon determining a power over consumption event has occurred, evaluating the monitored operational parameters to determine an appropriate corrective action, wherein the evaluation is performed by an expert system configured to evaluate one or more action/condition rules to determine the corrective action to be performed and wherein the corrective action comprises modifying an operational state of the compressor reflected in one of the operational parameters; and performing the corrective action for the compressor experiencing the power overconsumption event.

22. A computer-implemented method of performing condition-based predictive compressor maintenance, comprising:

determining, by operation of one or more computer processors, an estimated power consumption level of a compressor for a given time period;

monitoring one or more operational parameters of the compressor during the time period and an actual power consumption level of the compressor during the time period;

determining, by operation of one or more computer processors, whether a power over consumption event has occurred, based on the estimated power consumption level and the actual consumption level;

upon determining a power over consumption event has occurred, evaluating the monitored operational parameters to determine an appropriate corrective action; and performing the corrective action for the compressor experiencing the power overconsumption event, wherein the corrective action comprises modifying an operational state of the compressor reflected in one of the operational parameters and wherein a diagnostic and maintenance tool is further configured to log the corrective action performed for the compressor in a compressor status database configured to record values for the operational parameters and the actual power consumption level during occurring the time period.

* * * * *